US009539161B2

(12) United States Patent
Davis

(10) Patent No.: US 9,539,161 B2
(45) Date of Patent: Jan. 10, 2017

(54) MOVEABLE CORNER ELEMENT FOR A CASKET

(71) Applicant: Vandor Corporation, Richmond, IN (US)

(72) Inventor: Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 0 days.

(21) Appl. No.: 14/799,424

(22) Filed: Jul. 14, 2015

(65) Prior Publication Data

US 2016/0008202 A1 Jan. 14, 2016

Related U.S. Application Data

(60) Provisional application No. 62/024,169, filed on Jul. 14, 2014.

(51) Int. Cl.

| | |
|---|---|
| ***A61G 17/04*** | (2006.01) |
| ***A61G 17/02*** | (2006.01) |
| ***E05D 5/04*** | (2006.01) |
| ***E05D 5/06*** | (2006.01) |
| ***E05D 15/06*** | (2006.01) |
| *A61G 17/007* | (2006.01) |
| *A61G 17/00* | (2006.01) |

(52) U.S. Cl.

CPC ..... *A61G 17/04* (2013.01); *A61G 17/02* (2013.01); *E05D 5/046* (2013.01); *E05D 5/065* (2013.01); *E05D 15/063* (2013.01); *A61G 17/0076* (2013.01); *A61G 2017/004* (2013.01); *E05Y 2600/41* (2013.01); *E05Y 2600/56* (2013.01)

(58) Field of Classification Search

CPC ..... A61G 17/00; A61G 17/02; A61G 17/04; A61G 17/007; A61G 17/0073; A61G 2017/004; A61G 17/0076; E04H 13/00; E04H 13/006; E05D 5/046; E05D 5/065; E05D 15/063; E05Y 2600/41; E05Y 2600/56; E05F 19/064

USPC ..... 27/2, 4, 10, 35, 6; 52/287.1

See application file for complete search history.

(56) References Cited

U.S. PATENT DOCUMENTS 274,575 A * 3/1883 Eaton ..... A61G 17/02 27/2

2,213,506 A * 9/1940 Thoresen ..... A61G 17/04 27/10

(Continued)

*Primary Examiner* — William Miller

(74) *Attorney, Agent, or Firm* — Maginot, Moore & Beck LLP

(57) ABSTRACT

A casket assembly includes side panels, head and foot end panels, a bottom panel and at least a first corner element fixedly coupled to a foot end panel. The side panels are arranged opposite and parallel to each other. The head end panel is coupled between the first side panel and the second side panel. The bottom panel is coupled to the side panels and head end panel. The foot end panel is hingedly coupled to the bottom panel opposite the head end panel such that the foot end panel has open and closed positions. The first corner element defines first and second inner surfaces. The first inner surface extends along the foot end panel. The second inner surface abuts an outer surface of the side panel when the foot end panel is closed, and is spaced apart from the side panel when the foot end panel is open.

17 Claims, 7 Drawing Sheets

(56) References Cited

U.S. PATENT DOCUMENTS

| | | | | | |
|---|---|---|---|---|---|
| 3,613,189 | A * | 10/1971 | Kirby | A61G 17/04 | 27/35 |
| 4,177,543 | A * | 12/1979 | Angermann | A61G 17/00 | 27/35 |
| 4,788,757 | A * | 12/1988 | Bethune | A61G 17/00 | 27/12 |
| 6,324,737 | B1 * | 12/2001 | Chamness | A61G 17/04 | 27/1 |
| 6,684,467 | B1 * | 2/2004 | Walker | A61G 17/00 | 27/35 |
| 7,302,743 | B2 * | 12/2007 | Fash | A61G 17/00 | 16/424 |
| 7,350,278 | B2 * | 4/2008 | Davis | A61G 17/00 | 27/2 |
| 8,127,414 | B2 * | 3/2012 | Rankin | A61G 17/02 | 27/27 |
| 8,607,423 | B2 * | 12/2013 | Davis | A61G 17/0073 | 27/12 |
| 8,914,953 | B1 * | 12/2014 | Thacker | A61G 17/0076 | 27/35 |
| 2010/0218351 | A1 * | 9/2010 | Rankin | A61G 17/02 | 27/17 |
| 2013/0160258 | A1 * | 6/2013 | Davis | A61G 17/0073 | 27/2 |

* cited by examiner

MOVEABLE CORNER ELEMENT FOR A CASKET

PRIORITY CLAIM

This application claims priority to U.S. provisional patent application No. 62/024,169, filed on Jul. 14, 2014, the disclosure of which is incorporated herein by reference in its entirety.

FIELD OF THE INVENTION

The present invention generally relates to caskets. More particularly, the present invention relates to a corner of a casket container.

BACKGROUND

Burial or cremation containers, referred to herein collectively as caskets, are one of the most expensive elements of a traditional funeral. Costs associated with traditional caskets are attributable in significant part to the material and labor cost of forming a casket of wood or metal material. Accordingly, one way to reduce casket (and hence funeral) costs includes the use of caskets made from alternative materials, such as paperboard. Such caskets are particularly suitable for cremation. However, caskets constructed of alternative materials of paperboard often do not provide as pleasing a presentation of the deceased during the wake or viewing. While advances in the construction of paperboard caskets have resulted in aesthetic improvements, such caskets still lack the aesthetic appeal of traditional wood caskets.

One solution to the countervailing tensions of reducing cost and retaining aesthetic appeal of wood (or metal) caskets involves the use of a reusable rental casket. Specifically, if a casket is desired for a traditional ceremony or viewing but not needed for burial because cremation has been elected, a paperboard casket or body tray may be inserted into a more ornate rental casket to provide an aesthetic viewing experience. In many cases, the paperboard casket is inserted into or removed from the rental casket via a removable or fold-down end panel.

One of the issues of known rental systems arises from the joints or seams where the moveable end panel meets the adjacent side panels. In many cases, all or some of the joint or seam between the moveable end panel and the side panel is visible. A visible gap formed at the seam between the panels reduces the aesthetic qualities of the rental casket as well as makes it easily identifiable as a rental casket to those present at the wake or viewing. One method for reducing the visibility of the gap is to cut the ends of the end panel and the side panels at a 45 degree angle to form mitered joints. However, this method requires additional machining precision and also does not completely eliminate visibility of the gap.

There is a need, therefore, for a rental casket system that provides the full aesthetic value of a traditional casket by concealing the seams between the moveable end panel and the adjacent side panels.

SUMMARY

One or more of the embodiments of the present invention provides an arrangement that includes a casket with a fold down end panel hingedly connected to a bottom panel. When in a closed position, the end panel is connected by a latch assembly to at least one side panel. At least one corner element is arranged on the outside of the casket over the seam formed between the at least one side panel and the end panel. The corner element is fixedly attached to the end panel, and abuts the side panel when the end panel is in the closed position.

A first exemplary embodiment is a casket assembly that includes first and second side panels, head end and foot end panels, a bottom panel and at least a first corner element fixedly coupled to the foot end panel. The first and second side panels are arranged opposite and parallel to each other. The head end panel is coupled to and between the first side panel and the second side panel. The bottom panel is coupled to the first side panel, the second side panel, and the head end panel. The foot end panel is hingedly coupled to the bottom panel opposite the head end panel such that the foot end panel is moveable between a closed position, wherein at least a portion of the foot end panel abuts the first side panel and the second side panel, and an open position.

The first corner element defines first and second inner surfaces. At least a portion of the first inner surface extending along and abutting the foot end panel. The second inner surface extends substantially perpendicularly from the foot end panel and is configured to extend along an outer surface of the first side panel when the foot end panel is in the closed position, and to be spaced apart from the first side panel when the foot end panel is in the open position.

In some embodiments, mitered joints between the moveable end panel and the side panel are no longer necessary, as the seam is covered by the corner element. Accordingly, the moveable end panel and the stationary side panel can be adjoined by abutting flat ends at a butt joint in some embodiments, rather than mitered ends at a mitered joint.

The above-described features and advantages, as well as others, will become more readily apparent to those of ordinary skill in the art by reference to the following detailed description and accompanying drawings.

DETAILED DESCRIPTION

Figure 1:
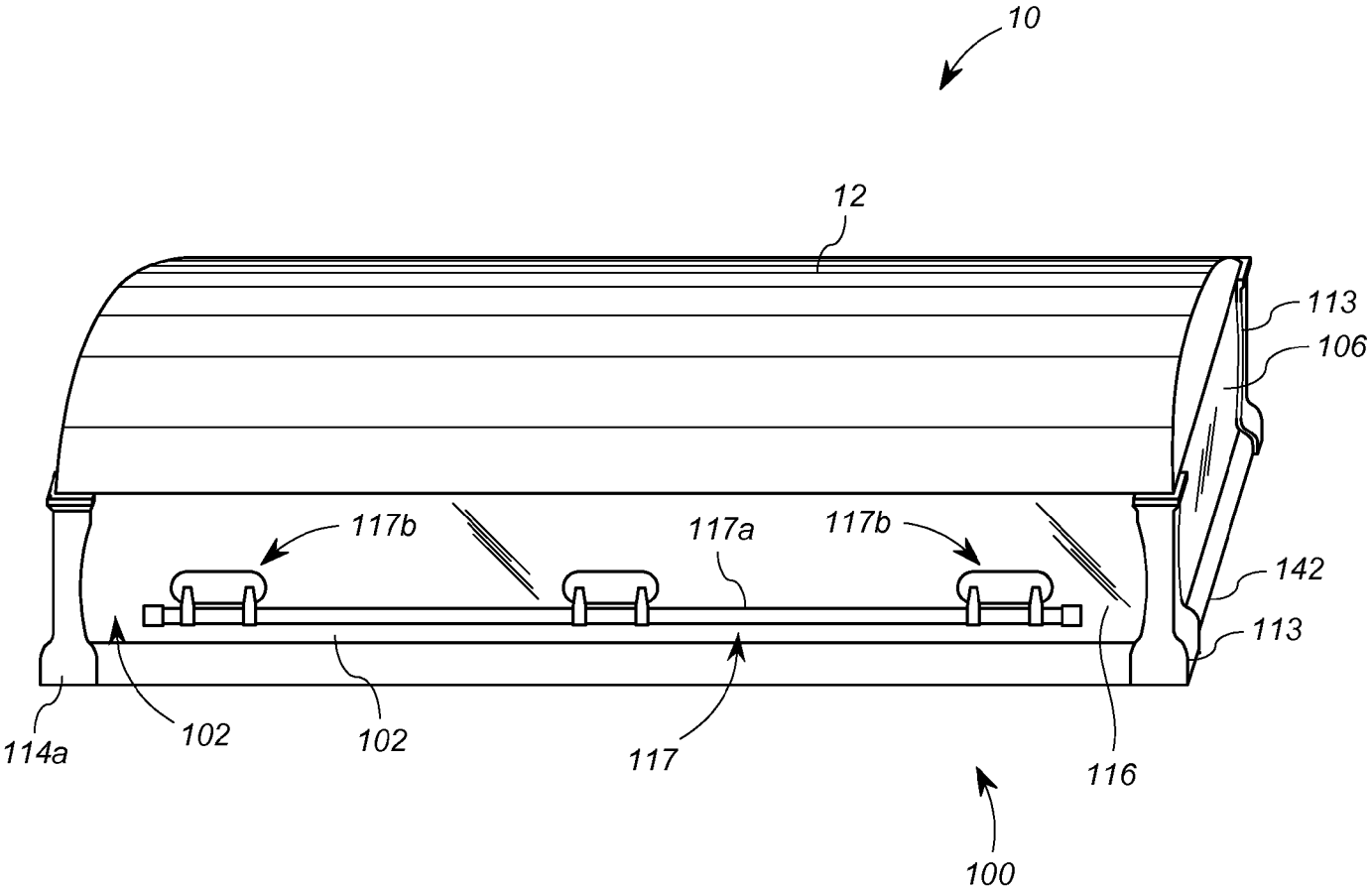
FIG. 1 depicts a perspective view of a rental casket according to a first embodiment of the invention.

FIG. 1 shows a perspective view of a rental casket 10 having a rental casket body 100 and a casket lid 12. In this embodiment, the casket body 100 forms a container that is sized an configured to receive an adult human deceased. The lid 12 is shown in as single lid covering the entire casket body 100. However, it will be appreciated that in other embodiments, the lid 12 may be a two part structure that cooperate collective cover the casket body 100.

Figure 2A:
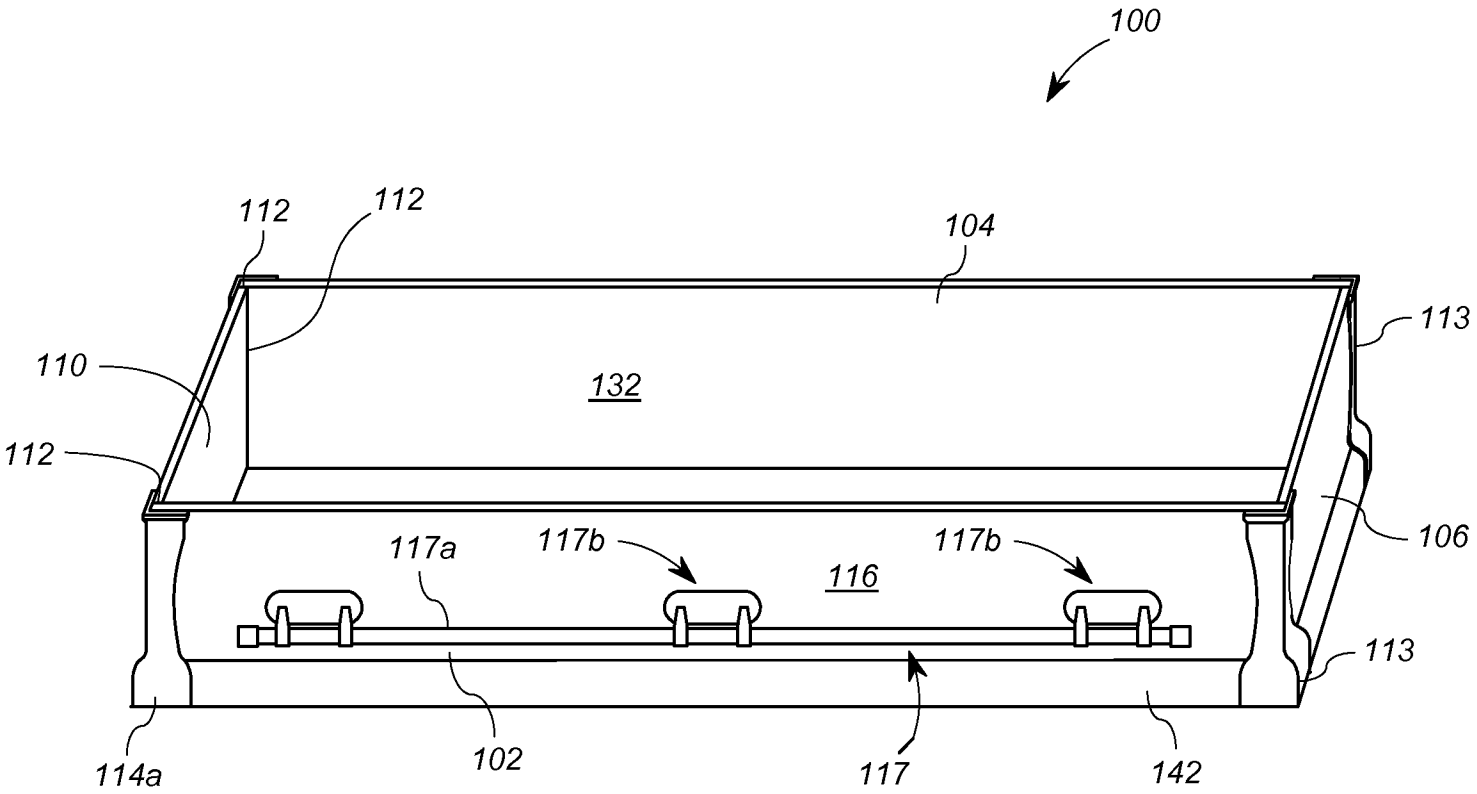
FIG. 2A depicts a perspective view of the rental casket body of the rental casket of FIG. 1 having an end panel in a closed position.
Figure 2B:
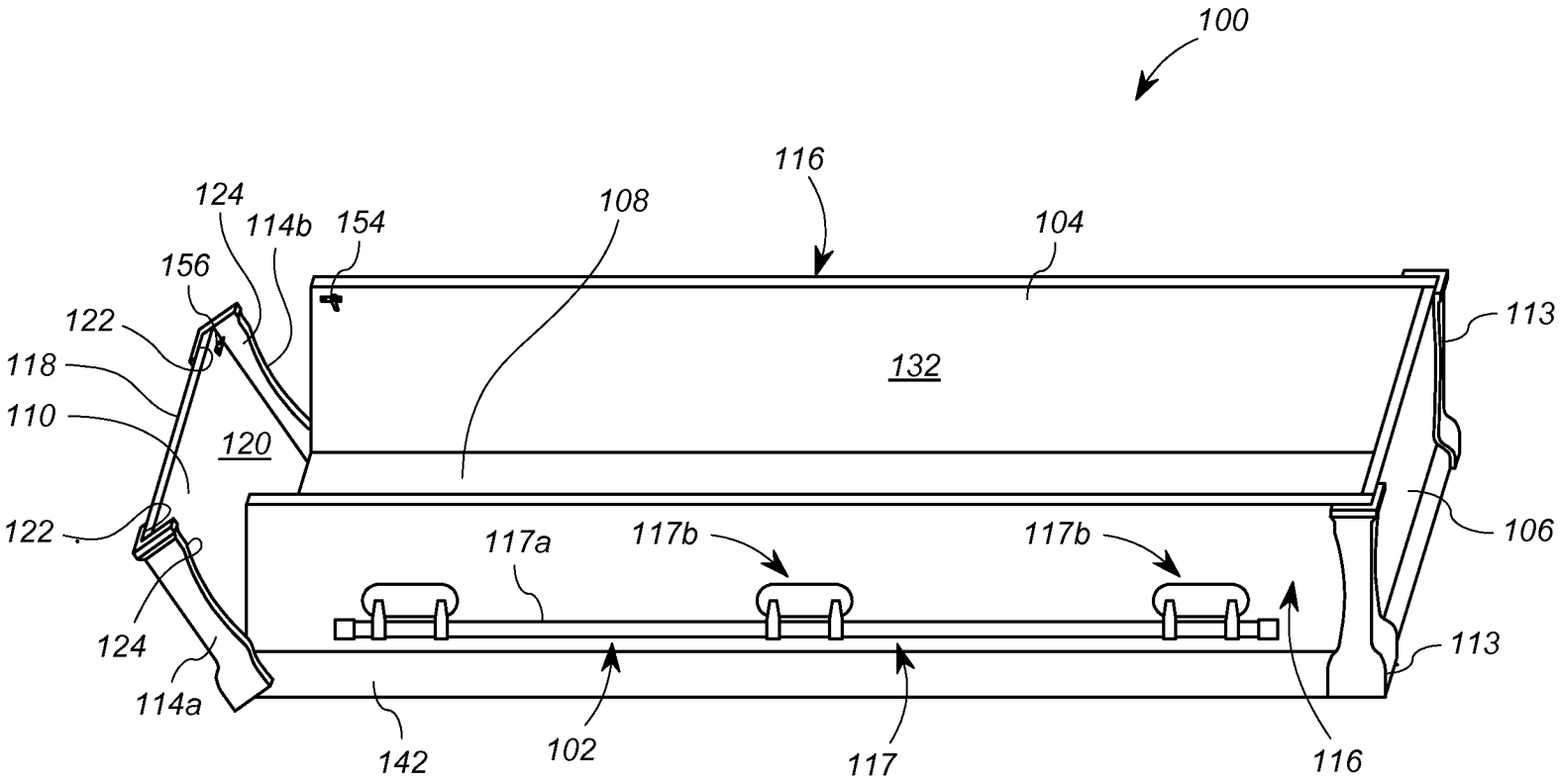
FIG. 2B depicts a perspective view of the rental casket body of FIG. 2A with the end panel in an open position.

FIGS. 2A and 2B show the casket body 100 in further detail. With general reference to FIGS. 1, 2A and 2B, the rental casket body 100 includes a first side panel 102, a second side panel 104, a head end panel 106, a bottom panel 108 (shown in FIGS. 2A and 2B), and a foot end panel 110 (shown in FIGS. 2A and 2B). The second side panel 104 is arranged opposite and parallel to the first side panel 102, the head end panel 106 is coupled to and between the first side panel 102 and the second side panel 104, and the bottom panel 108 is fixedly coupled to the first side panel 102, the second side panel 104, and the head end panel 106.

The foot end panel 110 is hingedly coupled to the bottom panel 108 opposite the head end panel 106 such that the foot end panel 110 is movable between a closed position, shown in FIG. 2A, and an open position, shown in FIG. 2B. When the foot end panel 110 is in the closed position, the casket arrangement 100 forms a container for displaying a deceased. Conversely, when the foot end panel 110 is in the open position, the casket arrangement 100 is configured to receive an casket insert, not shown, but on which the deceased may be disposed. When the foot end panel 110 is in the open position, the casket inset, not shown, may be inserted into and consequently removed from the casket body 100. This allows for multiple re-use of the casket body 100.

As shown in FIG. 2A, in the closed position, the foot end panel 110 abuts the first side panel 102 and the second side panel 104 and is arranged opposite and parallel to the head end panel 106. Joints or seams 112 are formed where the foot end panel 110 abuts the first side panel 102 and the second side panel 104. In contrast, as shown in FIG. 2B, in the open position, the foot end panel 110 does not abut the first side panel 102 or the second side panel 104 and is not parallel to the head end panel 106. As further shown in FIGS. 2A and 2B, stationary corner elements 113 are fixedly coupled to the casket body 100 where the head end panel 106 abuts the first and second side panels 102, 104 and movable corner elements 114*a*, 114*b* are fixedly coupled to the foot end panel 110 where the foot end panel 110 abuts the first and second side panels 102, 104. When the casket body 100 is in the closed position, as shown in FIG. 2A, the movable corner elements 114 extend over and cover the seams 112. This arrangement is advantageous because by minimizing the visibility of the seams 112, the movable corner elements 114 improve the aesthetic appearance of the casket body 100. Additionally, the movable corner elements 114 look substantially the same as the stationary corner elements 113 which reduces noticeability of the hinged attachment of the foot end panel 110 to the casket body 100.

The corner elements 114*a*, 114*b* can be made of, for example, a plastic material which is lightweight and durable. The corner elements 114*a*, 114*b* can be formed by, for example, molding, or another inexpensive plastics manufacturing process. In alternative embodiments, the corner elements 114 can be formed of another lightweight and durable material. For example, the corner elements 114 can be made of a wood material, which is carved. The corner elements 114*a*, 114*b* can be fixedly coupled to the foot end panel 110 by, for example, adhesive or another effective method which is not readily visible when the corner elements 114 are affixed to the foot end panel 110.

In one embodiment, the panels 102, 104, 106 and 110 are cloth covered wood, particle board, or corrugated paper panels. In other embodiment, the panels 102, 104, 106 and 110 are uncovered wood or other material.

Each of the first and second side panels 102, 104 includes an outer surface 116 which faces away from the opposite side panel. In preferred embodiments, a handle structure 117 is affixed to each of the outer surfaces 116. The handle structure may suitably include a long bar 117*a*, and a plurality of connecting units 117*b* that moveably or fixedly couple the bar 117*a* to the respective sides 102, 104.

Additionally, the foot end panel 110 includes an outside surface 118 which faces away from the head end panel 106 when in the closed position, and includes an inside surface 120 (shown in FIG. 2A), which faces toward the head end panel 106 when in the closed position.

The first corner element 114*a* is arranged adjacent to the first side panel 102 and the second corner element 114*b* is arranged adjacent to the second side panel 104. Each of the corner elements 114*a*, 114*b* includes a first inner surface 122 (see also FIGS. 3 and 4) which is fixedly coupled to the outside surface 118 of the foot end panel 110. Thus, the first inner surface 122 of each of the corner elements 114*a*, 114*b* is arranged substantially parallel to the outside surface 118 of the foot end panel 110.

Figure 3:
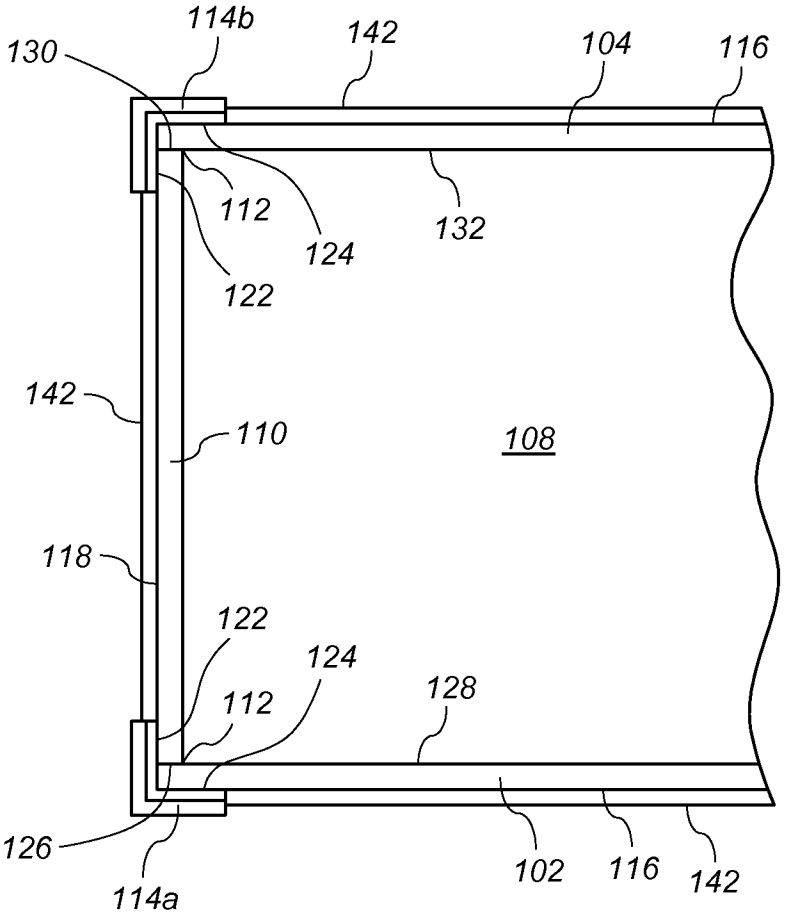
FIG. 3 depicts a fragmentary top view of a portion of the rental casket body of FIG. 2A with the end panel in the closed position.
Figure 4:
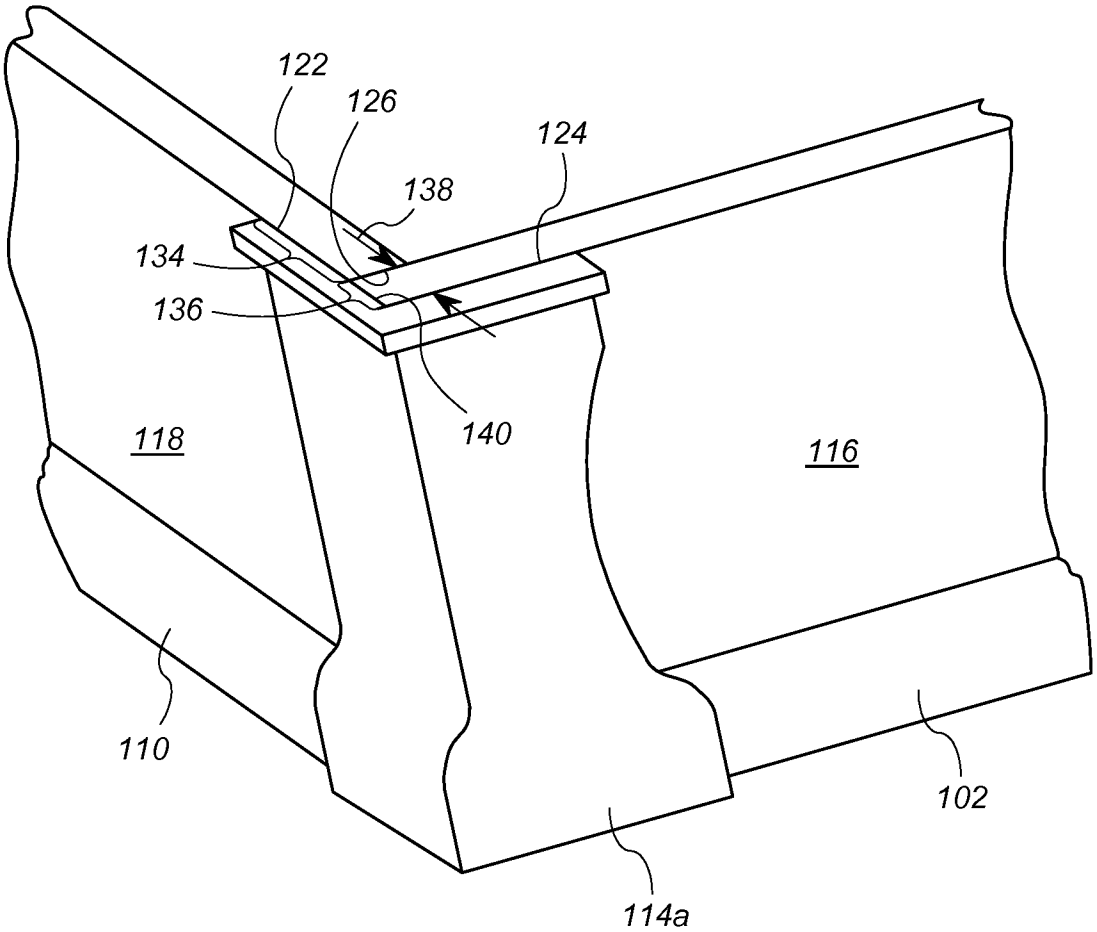
FIG. 4 depicts an enlarged, fragmentary perspective view of a portion of the rental casket body of FIG. 2A with the end panel in the closed position.

Each of the corner elements 114*a*, 114 also includes a second inner surface 124 (see also FIGS. 3 and 4). The second inner surface 124 of the first corner element 114*a* abuts the outer surface 116 of the first side panel 102 and the second inner surface 124 of the second corner element 114*b* abuts the outer surface 116 of the second side panel 104 when the foot end panel 110 is in the closed position. When the foot end panel 110 is in the open position, the second inner surfaces 124 are spaced apart from the outer surfaces 116 of the first and second side panels 102, 104. Each of the second inner surfaces 124 of the corner elements 114*a*, 114*b* are arranged at substantially right angles relative to the corresponding first inner surface 122. In other words, the second inner surface 124 of each of the corner elements 114*a*, 114*b* is substantially perpendicular to the outside surface 118 of the foot end panel 110.

As shown more clearly in FIG. 3, at the seams 112, the foot end panel 110 includes a first edge 126 arranged adjacent to and facing toward an inner surface 128 of the first side panel 102 and a second edge 130 arranged adjacent to and facing toward an inner surface 132 of the second side panel 104. The first edge 126 of the foot end panel 110 abuts the inner surface 128 of the first side panel 102 and the second edge 130 of the foot end panel 110 abuts the inner surface 132 of the second side panel 104 when the foot end panel 110 is in the closed position. The first edge 126 forms a short surface that is substantially perpendicular to the outer surface 118 of the foot end panel 110, and parallel to the inner surface 128. As a consequence, the foot end panel 110 forms a butt joint with each of the first and second side panels 102, 104 at seams 112 such that the foot end panel 110 is arranged inwardly of the first and second side panels 102, 104. This arrangement enables the seams 112 to be arranged on the foot end of the casket body 100, a location which minimizes their visibility.

In an alternative embodiment, the first edge 126 of the foot end panel 110 can be coplanar with the outer surface 116 of the first side panel 102 and the second edge 130 of the foot end panel 110 can be coplanar with the outer surface 116 of the second side panel 104 when the foot end panel 110 is in the closed position. In this embodiment, the foot end panel 110 also forms a butt joint with each of the first and second side panels 102, 104 at the seams 112. However, in this embodiment, the foot end panel 110 is not arranged inwardly of the first and second side panels 102, 104. Accordingly, in this embodiment, the seams 112 are arranged on the first and second sides of the casket body 100.

Turning now to FIG. 4, the first corner element 114*a*, a portion of the foot end panel 110, and a portion of one of the first and second side panels 102, 104 are shown in greater detail. The corner element 114*b* will have the substantially the same structure (although in mirror image if the corner element 114*a* is asymmetrically designed). Thus, while the first corner element 114*a* and the first side panel 102 are shown in FIGS. 4-6 and described herein, the same description in a mirrored arrangement applies to the second corner element 114*b* and the second side panel 104 on the opposite side of the casket body 100.

As shown in FIG. 4, the first inner surface 122 of the first corner element 114*a* is coupled to the outside surface 118 of the foot end panel 110 such that the first corner element 114*a* extends beyond the first edge 126 of the foot end panel 110. In other words, a first portion 134 of the first inner surface 122 of the first corner element 114*a* is fixedly coupled to the outside surface 118 of the foot end panel 110 and a second portion 136 of the first inner surface 122 of the first corner element 114*a* extends past the first edge 126 of the foot end panel 110 to define a gap 138 (also shown in FIG. 5) between the second inner surface 124 of the first corner element 114*a* and the first edge 126 of the foot end panel 110. The gap 138 receives a portion of first side panel 102 when the foot end panel 110 is in the closed position such that an edge 140 (also shown in FIG. 5) of the first side panel 102 abuts the second portion 136 of the first inner surface 122 of the first corner element 114*a*. This arrangement is advantageous because it enhances the structural stability of the casket arrangement 100 by enabling the first corner element 114*a* to abut the first side panel 102 on both the first and second inner surfaces 122, 124. This arrangement also enables the movable foot end panel 110 to be braced against and retained between the first and second side panels 102, 104.

In an alternative embodiment, wherein the foot end panel 110 is not arranged inwardly of the first side panel 102, the first corner element 114*a* does not extend past the first edge 126 of the foot end panel 110. Instead, the first corner element 114*a* is fixedly coupled to the foot end panel 110 such that the outside surface 118 of the foot end panel 110 abuts the entirety of the first inner surface 122 of the first corner element 114*a* and the first edge 126 of the foot end panel 110 abuts the second inner surface 124 of the first corner element 114*a*. In this embodiment, the edge 140 of the first side panel 102 abuts the inside surface 120 of the foot end panel 110 when the foot end panel 110 is in the closed position. In another alternative embodiment, the foot end panel 110 can be arranged inwardly of one of the first side panel 102 and the second side panel 104 and not the other. For example, when the foot end panel 110 is in the closed position, the edge 140 of the first side panel 102 can abut the inside surface 120 of the foot end panel 110, and the second edge 130 of the foot end panel 110 can abut the inner surface 132 of the second side panel 104.

Figure 5:
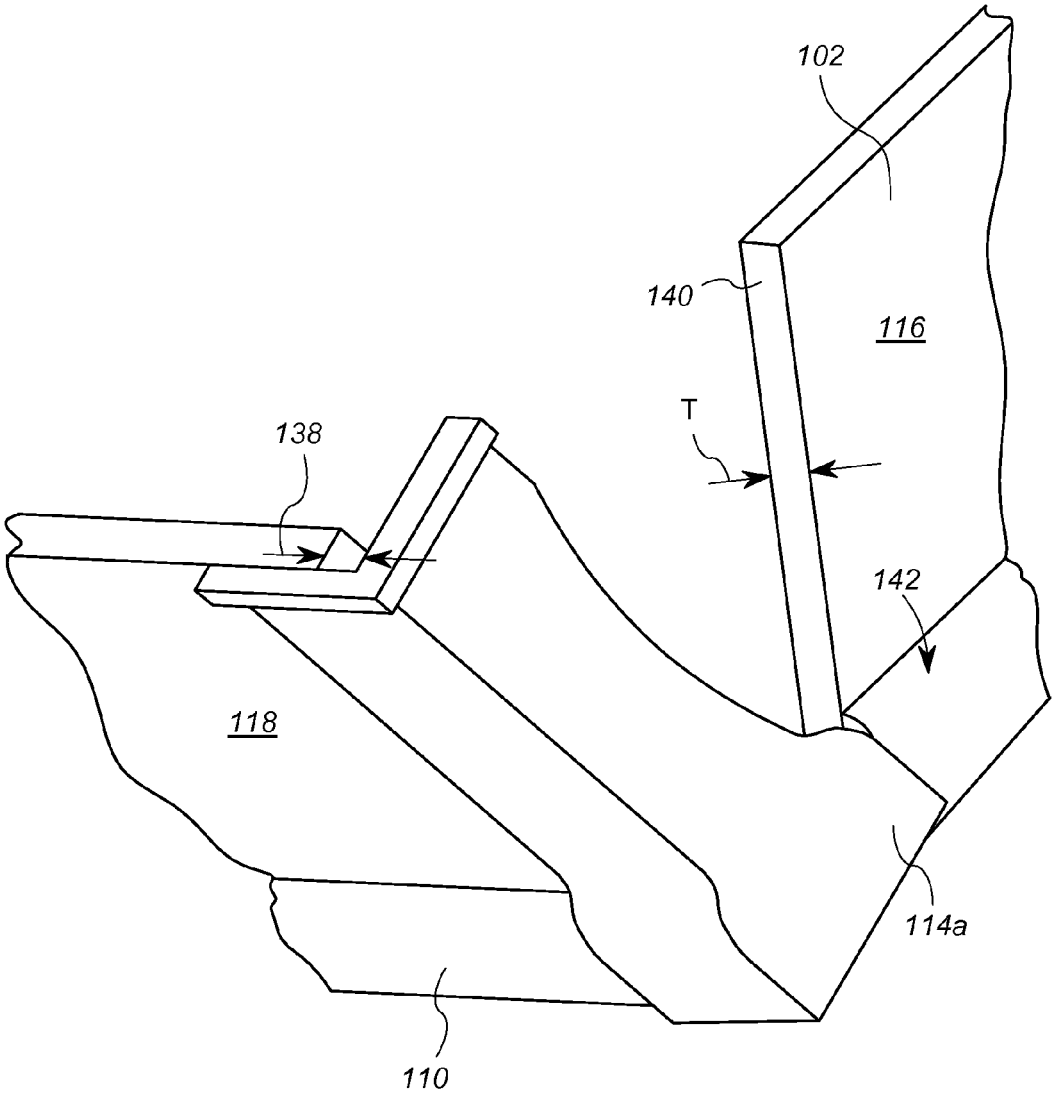
FIG. 5 depicts an enlarged, fragmentary perspective view of a portion of the rental casket body of FIG. 2A with the end panel in a partially open position.
Figure 6:
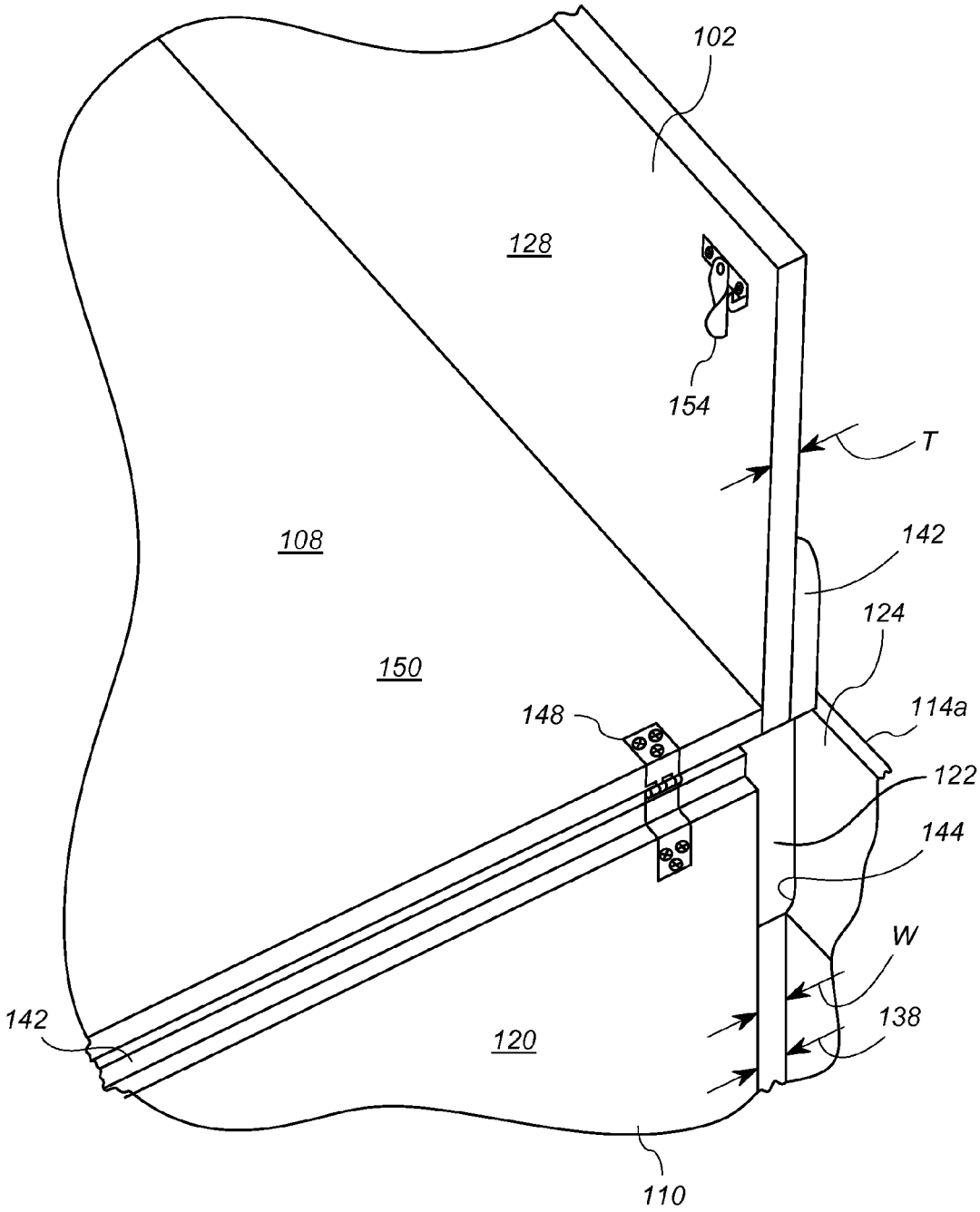
FIG. 6 depicts an enlarged, fragmentary perspective view of a portion of the rental casket body of FIG. 2A with the end panel in the open position.

FIG. 5 depicts the foot end panel 110 in a position between the closed position and the open position, in a partially open position, wherein the first corner element 114*a* is somewhat spaced apart from the edge 140 of the first side panel 102. As shown, the outer surface 116 of the first side panel 102 includes a contour 142 which extends outwardly near the bottom of the foot end panel 110. In other words, the contour 142 is formed extending outwardly in a cross-section of the first side panel 102 taken in a direction parallel to the edge 140. Accordingly, the front side panel 102 has a thickness T which is wider at the contour 142. All of the panels 102, 104, 106 and 110 preferably include a similar contour 142, which may be formed by a bottom molding piece attached to the flat or plate main structure of the panels 102, 104, 106 and 110.

Turning now to FIG. 6, to accommodate the contour 142, the corner element 114*a* includes a contour receiver 144 configured to matingly receive the contour 142 when the foot end panel 110 is in the closed position. The contour receiver 144 is integrally formed with the gap 138 and can be considered a portion of the gap 138. In other words, the gap 138 has a width W which varies to accommodate the varying thickness T of the front side panel 102. The width W of the gap 138 is wider at the contour receiver 144. The width W of the gap 138 is larger than the thickness T of the front side panel 102 such that the front side panel 102 can be received within the gap 138. The second side panel 104 also includes a contour 142 substantially similar to that of the first side panel 102, and the second corner element 114*b* is configured to receive the second side panel 104 in substantially the same way that the first corner element 114*a* receives the first side panel 102.

As shown in FIGS. 1 and 2, the foot end panel 110 can also include a contour substantially similar to the contour 142 formed in the first and second side panels 102, 104. In such an embodiment, the first inner surfaces 122 of each of the corner elements 114 also include contour receivers configured to matingly receive the contour formed in the foot end panel 110.

As shown in FIG. 6, the casket body 100 also includes hinges 148 configured to hingedly couple the foot end panel 110 to the bottom panel 108 of the casket body 100. To minimize visibility and interference, the hinges 148 are coupled to the inside surface 120 of the foot end panel 110 and an upper surface 150 of the bottom panel 108 such that the hinges 148 are substantially flat against the surfaces 120, 150. By way of example, the hinges 148 can be screwed onto the surfaces 120, 150. One hinge 148 is shown in FIG. 6, however, more than one hinge 148 can be used to hingedly couple the foot end panel 110 to the bottom panel 108. For example, one hinge 148 can be fixedly coupled to the foot end panel 110 and the bottom panel 108 near the first side panel 102 and another hinge 148 can be fixedly coupled to the foot end panel 110 and the bottom panel 108 near the second side panel 104 such that the foot end panel 110 is evenly supported by two hinges 148 on the bottom panel 108.

The casket body 100 includes a latch assembly configured to retain the foot end panel 110 in the closed position. As shown in FIG. 6, the latch assembly includes a side panel latch portion 154 fixedly coupled to the inner surface 128 of the first side panel 102 and, as shown in FIGS. 1 and 2, a side panel latch portion 154 fixedly coupled to the inner surface 132 of the second side panel 104. The latch assembly also includes end panel latch portions 156 fixedly coupled to the inside surface 120 of the foot end panel 110 and configured to engage with the side panel latch portions 154 to retain the foot end panel 110 in the closed position. The latch assembly is configured such that the side panel latch portions 154 and the end panel latch portions 156 are manually disengageable.

The side panel latch portions 154 and the end panel latch portions 156 are configured to minimize visibility and interference while securely retaining the foot end panel 110 in the closed position. In alternative embodiments, the latch assembly can have a different configuration that minimizes visibility and interference while securely retaining the foot end panel 110 in the closed position.

It will be appreciated that one of the advantages of this embodiment is that the corner elements 113, 114*a*, 114*b* extend substantially all the way from the bottom of the panels 102, 104, 106 and 110 to the top. Accordingly, the seams between the side panels 102, 104 and the panels 106 and 110 may take any form without detracting from the aesthetic appearance of the casket body 100. This allows, for example for the intersection between each of the side panels 102, 104 and the head end panel 106 to be a butt joint, as opposed to a mitered joint. This provides greater strength without visually exposing a butt joint seam. Furthermore, it allows for the casket body 100 to be formed of cloth-covered panels, which otherwise tend to have more visible seams.

In use, the foot end panel 110 is placed into the fully open position (FIG. 6) for insertion of the casket insert, not shown, but which is known in the art, which holds the deceased. The casket insert is typically in the form of a tray or open-top box that is shaped to be slid into the casket body 100 via the opening formed by the open foot end panel 110. Once the casket insert is fully within the casket body 100, the foot end panel 110 is moved upwardly into the closed position (FIGS. 2 and 4), and latched shut via latch portions 152, 154. The casket 10 may then be employed in funerary proceedings in the same manner as traditional non-rental caskets. After viewings and funerary services for the deceased are completed, the foot end panel 110 is again moved into the fully open position. The casket insert and deceased are removed through the resulting opening. The casket body 100 may then be re-used in a similar fashion.

It will be appreciated that the above-described embodiments are merely illustrative, and that those of ordinary skill in the art may readily devise their own implementations and modifications that incorporate the principles of the invention and fall within the spirit and scope thereof.

What is claimed is:

1. A casket assembly, comprising:

a first side panel;

a second side panel arranged opposite and parallel to the first side panel;

a head end panel coupled to and between the first side panel and the second side panel;

a bottom panel coupled to the first side panel, the second side panel, and the head end panel;

a foot end panel hingedly coupled to the bottom panel opposite the head end panel such that the foot end panel is moveable between a closed position, wherein at least a portion of the foot end panel abuts the first side panel and the second side panel, and an open position; and at least a first corner element fixedly coupled to the foot end panel, the first corner element defining first and second inner surfaces, at least a portion of the first inner surface extending along and abutting the foot end panel, the second inner surface extending substantially perpendicularly from the foot end panel and configured to extend along an outer surface of the first side panel when the foot end panel is in the closed position, and to be spaced apart from the first side panel when the foot end panel is in the open position; and wherein the foot end panel includes an outside surface facing away from the head end panel when the foot end panel is in the closed position, and the first corner element is fixedly coupled to the outside surface of the foot end panel.

2. The casket assembly of claim 1, wherein a further portion of the first inner surface extends past a first edge the foot end panel to define a gap between the second inner surface and the first edge of the foot end panel, wherein the gap receives a portion of the first side panel when the foot end panel is in the closed position.

3. The casket assembly of claim 2, wherein:

the first side panel has a thickness;

the gap has a width which is greater than the thickness; and the gap receives the thickness of the first side panel when the foot end panel is in the closed position.

4. The casket assembly of claim 1, further comprising:

a hinge fixedly coupled to a bottom portion of the foot end panel and to a foot portion of the bottom panel and configured to enable the foot end panel to rotate relative to the bottom panel.

5. The casket assembly of claim 1, wherein:

the bottom panel has a total width extending from the outer surface of the first side panel to an outside surface of the second side panel, the foot end panel has a width extending from a first edge arranged facing toward the first side panel to a second edge arranged facing toward the second side panel, and the total width of the bottom panel is greater than the width of the foot end panel.

6. The casket assembly of claim 5, wherein:

the bottom panel has an inner width extending from an inside surface of the first side panel to an inside surface of the second side panel, and the inner width of the bottom panel is greater than the width of the foot end panel.

7. A casket assembly, comprising:

a first side panel;

a second side panel arranged opposite and parallel to the first side panel;

a head end panel coupled to and between the first side panel and the second side panel;

a bottom panel coupled to the first side panel, the second side panel, and the head end panel;

a foot end panel hingedly coupled to the bottom panel opposite the head end panel such that the foot end panel is moveable between a closed position, wherein at least a portion of the foot end panel abuts the first side panel and the second side panel, and an open position; and at least a first corner element fixedly coupled to the foot end panel, the first corner element defining first and second inner surfaces, at least a portion of the first inner surface extending along and abutting the foot end panel, the second inner surf ace extending substantially perpendicularly from the foot end panel and configured to extend along an outer surface of the first side panel when the foot end panel is in the closed position, and to be spaced apart from the first side panel when the foot end panel is in the open position;

wherein the first side panel and the foot end panel define a seam when the foot end panel is in the closed position, and wherein the first corner element extends over and covers the seam.

8. The casket assembly of claim 7, wherein the foot end panel further includes a first outer surface opposite the first inner surface, and a second outer surface opposite the second inner surface, each of the first outer surface and the second outer surface being contoured.

9. The casket assembly of claim 7, further comprising:

a second corner element fixedly coupled to the foot end panel opposite the first corner element, the second corner element defining first and second inner surfaces, at least a portion of the first inner surface extending along and abutting the foot end panel, the second inner surface extending substantially perpendicularly from the foot end panel and configured to extend along an outer surface of the second side panel when the foot end panel is in the closed position, and to be spaced apart from the second side panel when the foot end panel is in the open position.

10. The casket assembly of claim 9, wherein:

the foot end panel includes an outside surface facing away from the head end panel when the foot end panel is in the closed position, and the first and second corner elements are fixedly coupled to the outside surface of the foot end panel.

11. The casket assembly of claim 9, wherein:

a further portion of the first inner surface of the first corner element extends past a first edge of the foot end panel to define a first gap between the second inner surface of the first corner element and the first edge of the foot end panel, the first gap receiving a portion of the first side panel when the foot end panel is in the closed position, and a further portion of the first inner surface of the second corner element extends past a second edge of the foot end panel to define a second gap between the second inner surface of the second corner element and the second edge of the foot end panel, the second gap receiving a portion of the second side panel when the foot end panel is in the closed position.

12. The casket assembly of claim 11, wherein:

the first side panel has a first thickness and the second side panel has a second thickness, the first gap has a first width which is greater than the first thickness and the second gap has a second width which is greater than the second thickness, and the first gap receives the first thickness of the first side panel and the second gap receives the second thickness of the second side panel when the foot end panel is in the closed position.

13. The casket assembly of claim 12, wherein:

the first width is substantially equal to the second width.

14. The casket assembly of claim 9, wherein:

the first side panel and the foot end panel define a first seam when the foot end panel is in the closed position, the first corner element extending over and covering the first seam, and the second side panel and the foot end panel define a second seam when the foot end panel is in the closed position, the second corner element extending over and covering the second seam.

15. A casket assembly, comprising:

a first side panel;

a second side panel arranged opposite and parallel to the first side panel;

a head end panel coupled to and between the first side panel and the second side panel;

a bottom panel coupled to the first side panel, the second side panel, and the head end panel;

a foot end panel hingedly coupled to the bottom panel opposite the head end panel such that the foot end panel is moveable between a closed position, wherein at least a portion of the foot end panel abuts the first side panel and the second side panel, and an open position; and at least a first comer element fixedly coupled to the foot end panel, the first comer element defining first and second inner surf aces, at least a portion of the first inner surface extending along and abutting the foot end panel, the second inner surface extending substantially perpendicularly from the foot end panel and configured to extend along an outer surface of the first side panel when the foot end panel is in the closed position, and to be spaced apart from the first side panel when the foot end panel is in the open position;

at least one side panel latch portion fixedly coupled to an inside surface of one of the first side panel and the second side panel; and at least one end panel latch portion fixedly coupled to the foot end panel and configured to engage the at least one side panel latch portion when the foot end panel is in the closed position to latch the foot end panel in the closed position.

16. The casket assembly of claim 15, wherein:

the at least one side panel latch portion includes a first side panel latch portion fixedly coupled to the inside surface of the first side panel and a second side panel latch portion fixedly coupled to the inside surface of the second side panel, the at least one end panel latch portion includes a first end panel latch portion and a second end panel latch portion fixedly coupled to the foot end panel, and the first end panel latch portion is configured to engage the first side panel latch portion when the foot end panel is in the closed position and the second end panel latch portion is configured to engage the second side panel latch portion when the foot end panel is in the closed position.

17. A corner element coupled to a casket assembly having a head end panel and a foot end panel, the corner element configured to contact a side panel of the casket assembly, the corner element comprising:

a first inner surface fixedly coupled to an outside surface of the foot end panel of the casket assembly, the outside surface of the foot end panel facing away from the head end panel; and a second inner surface configured to contact an outer surface of the side panel of the casket assembly, wherein:

the corner element is rotatable with the foot end panel relative to the side panel of the casket assembly between a closed position, wherein the first inner surface of the corner element is in contact with the side panel of the casket assembly, and an open position, wherein the first inner surface of the corner element is not in contact with the side panel of the casket assembly.

* * * * *